US010670227B2

(12) United States Patent
Spencer et al.

(10) Patent No.: US 10,670,227 B2
(45) Date of Patent: Jun. 2, 2020

(54) HYPERBOLIC CEILING-REFLECTOR FOR DIRECTIONAL LIGHT SOURCES

(71) Applicant: ABL IP Holding LLC, Decatur, GA (US)

(72) Inventors: Charles Jeffrey Spencer, Wilmette, IL (US); Zhong Xie, Fishers, IN (US); Tony Geralds, Indianapolis, IN (US)

(73) Assignee: ABL IP Holding LLC, Atlanta, GA (US)

( * ) Notice: Subject to any disclaimer, the term of this patent is extended or adjusted under 35 U.S.C. 154(b) by 291 days.

(21) Appl. No.: 15/145,692

(22) Filed: May 3, 2016

(65) Prior Publication Data

US 2016/0245483 A1 Aug. 25, 2016

Related U.S. Application Data

(63) Continuation of application No. 13/599,643, filed on Aug. 30, 2012, now abandoned.

(51) Int. Cl.

| | |
|---|---|
| ***F21V 7/07*** | (2006.01) |
| ***F21S 8/02*** | (2006.01) |
| ***F21V 29/77*** | (2015.01) |
| ***F21V 29/70*** | (2015.01) |
| *F21Y 115/10* | (2016.01) |
| *F21Y 105/10* | (2016.01) |
| *F21Y 101/00* | (2016.01) |

(52) U.S. Cl.

CPC ..... *F21V 7/07* (2013.01); *F21S 8/026* (2013.01); *F21V 29/70* (2015.01); *F21V 29/773* (2015.01); *F21Y 2101/00* (2013.01); *F21Y 2105/10* (2016.08); *F21Y 2115/10* (2016.08)

(58) Field of Classification Search

CPC ..... F21V 7/07; F21V 29/70; F21V 29/773; F21S 8/026

See application file for complete search history.

(56) References Cited

U.S. PATENT DOCUMENTS

| | | | |
|---|---|---|---|
| 1,306,511 | A | 6/1919 | Ames |
| 7,178,937 | B2 | 2/2007 | McDermott |
| 7,581,855 | B2 | 9/2009 | Holder et al. |
| 8,277,063 | B2 | 10/2012 | Levon |

(Continued)

FOREIGN PATENT DOCUMENTS

| | | |
|---|---|---|
| WO | 2004033958 | 4/2004 |

OTHER PUBLICATIONS

Final Office Action for U.S. Appl. No. 13/599,643, dated Feb. 4, 2016, 13 pages.

(Continued)

*Primary Examiner* — Sharon E Payne

(74) *Attorney, Agent, or Firm* — Kilpatrick Townsend & Stockton LLP

(57) ABSTRACT

A downlight fixture includes an optic housing, a light-emitting diode (LED) array, and a lens-less reflector. The LED array emits directional light rays in a downward direction towards an illuminated target. The reflector is mounted within the optic housing and adjacent to the LED array. The reflector has a hyperbolic wall continuously extending between a narrow neck and a wide bell. The light rays are spread into a light beam within the reflector upon making contact solely with the hyperbolic wall.

19 Claims, 6 Drawing Sheets

(56) References Cited

U.S. PATENT DOCUMENTS

| | | | | |
|---|---|---|---|---|
| 8,568,011 | B2 * | 10/2013 | Rillie | F21S 19/00 359/591 |
| 8,622,598 | B2 | 1/2014 | Van Gorkom et al. | |
| 8,727,574 | B2 | 5/2014 | Simchak et al. | |
| 9,784,422 | B2 * | 10/2017 | Zhang | F21V 13/04 |
| 2005/0162845 | A1 | 7/2005 | McDermott et al. | |
| 2008/0068852 | A1 | 3/2008 | Goihl et al. | |
| 2009/0290349 | A1 * | 11/2009 | Chu | F21V 7/0008 362/249.02 |
| 2009/0302739 | A1 * | 12/2009 | Levon | A41D 27/085 313/483 |
| 2013/0250589 | A1 * | 9/2013 | Nezu | F21V 29/20 362/382 |
| 2014/0168944 | A1 * | 6/2014 | Osada | F21V 17/005 362/95 |

OTHER PUBLICATIONS

Non-Final Office Action for U.S. Appl. No. 13/599,643, dated Feb. 12, 2015, 14 pages.

Juno Lighting LLC, "Indy™ Performance Series LED Commercial Downlights Catalog," Feb. 2012, 44 pages.

* cited by examiner

HYPERBOLIC CEILING-REFLECTOR FOR DIRECTIONAL LIGHT SOURCES

CROSS-REFERENCE TO RELATED APPLICATIONS

This application is a continuation application of application Ser. No. 13/599,643, filed Aug. 30, 2012, pending, which is incorporated herein by reference in its entirety.

TECHNICAL FIELD

This invention is directed generally to lighting systems, and, more particularly, to a reflector having a hyperbolic shape for spreading directional light towards an illuminated target.

BACKGROUND OF THE INVENTION

Lighting designers typically evaluate the quality of a recessed light fixture based on how well the recessed fixture blends into a ceiling and how well the recessed fixture controls glare from a light source. Ideally, lighting designers prefer a "quiet" ceiling in which light is emitted without the recessed fixture and/or light source being noticeable. In other words, the ceiling should be free of concentrated light spots (i.e., "hot spots") that are produced by the recessed fixtures mounted in the ceiling.

Traditional light sources include incandescent, high-intensity discharge (HID), and compact-fluorescent (CFL) light sources, all of which emit light in all directions (i.e., non-directional light beam). To direct the non-directional light beam down from and out of a recessed fixture, lighting manufacturers have traditionally designed reflectors using a parabolic shape, which is intended to focus the non-directional light beam towards an illuminated target (e.g., a floor surface).

Rapid advancements in light-emitting diode ("LED") technology have caused manufacturers to replace the traditional light sources with LED light sources, which are inherently directional light sources. However, the manufacturers have continued using traditional reflectors (e.g., parabolic-shaped reflectors) to minimize glare and to provide a "quiet" ceiling. The combination of LED light sources with traditional reflectors fails to provide optimal lighting results.

BRIEF SUMMARY OF THE INVENTION

In an implementation of the present invention, a downlight fixture includes a housing can, a LED light source, and a hyperbolic reflector. The housing can is mounted within a ceiling below the LED light source, which generates directional light rays into the reflector. The reflector is hyperbolic shaped, e.g., in the form of a trumpet bell to minimize glare caused by the directional light rays. The reflector is positioned near the LED light source to receive the light rays. Upon contact with a reflector wall, the light rays are spread into a light beam that is redirected towards an illuminated surface (e.g., a floor surface).

In another implementation of the present invention, a downlight reflector for a light-emitting diode (LED) array has a narrow neck, a wide bell, and a hyperbolic wall. The narrow neck has a top opening for receiving light rays from the LED array. The wide bell has a bottom opening through which the light rays exit towards an illuminated target. The hyperbolic wall continuously extends between the narrow neck and the wide bell, the hyperbolic wall having an internal surface with an illuminated area and a non-illuminated area.

In another alternative implementation of the present invention, a downlight fixture includes an optic housing mounted in a ceiling, via a bracket, and a heat sink attached to the optic housing above the ceiling. The downlight fixture further includes a light-emitting diode (LED) light engine mounted directly to the heat sink and having at least one LED for emitting directional light rays in a downward direction towards an illuminated target. The downlight fixture also includes a hyperbolic reflector mounted within the optic housing and having a narrow opening adjacent to the LED light engine. The hyperbolic reflector has a narrow entry area continuously connected to a wide exit area via a hyperbolic wall. The light rays enter the reflector in an initial direction and continue in the same direction until making contact with an internal surface of the hyperbolic wall. The light rays spread into a light beam in response to making contact with the internal surface of the hyperbolic wall. The light beam exits the hyperbolic reflector through the wide exit area.

In another alternative implementation of the present invention, a downlight fixture includes an optic housing, a light-emitting diode (LED) array, and a lens-less reflector. The LED array emits directional light rays in a downward direction towards an illuminated target. The reflector is mounted within the optic housing and adjacent to the LED array. The reflector has a hyperbolic wall continuously extending between a narrow neck and a wide bell. The neck area has a top opening through which the light rays enter the reflector in a straight path. The light rays continue in the straight path within the reflector and are spread into a light beam upon making contact solely with the hyperbolic wall. The bell area has a bottom opening through which the light beam exits the reflector towards the illuminated target.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE PREFERRED EMBODIMENTS

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

Figure 1:
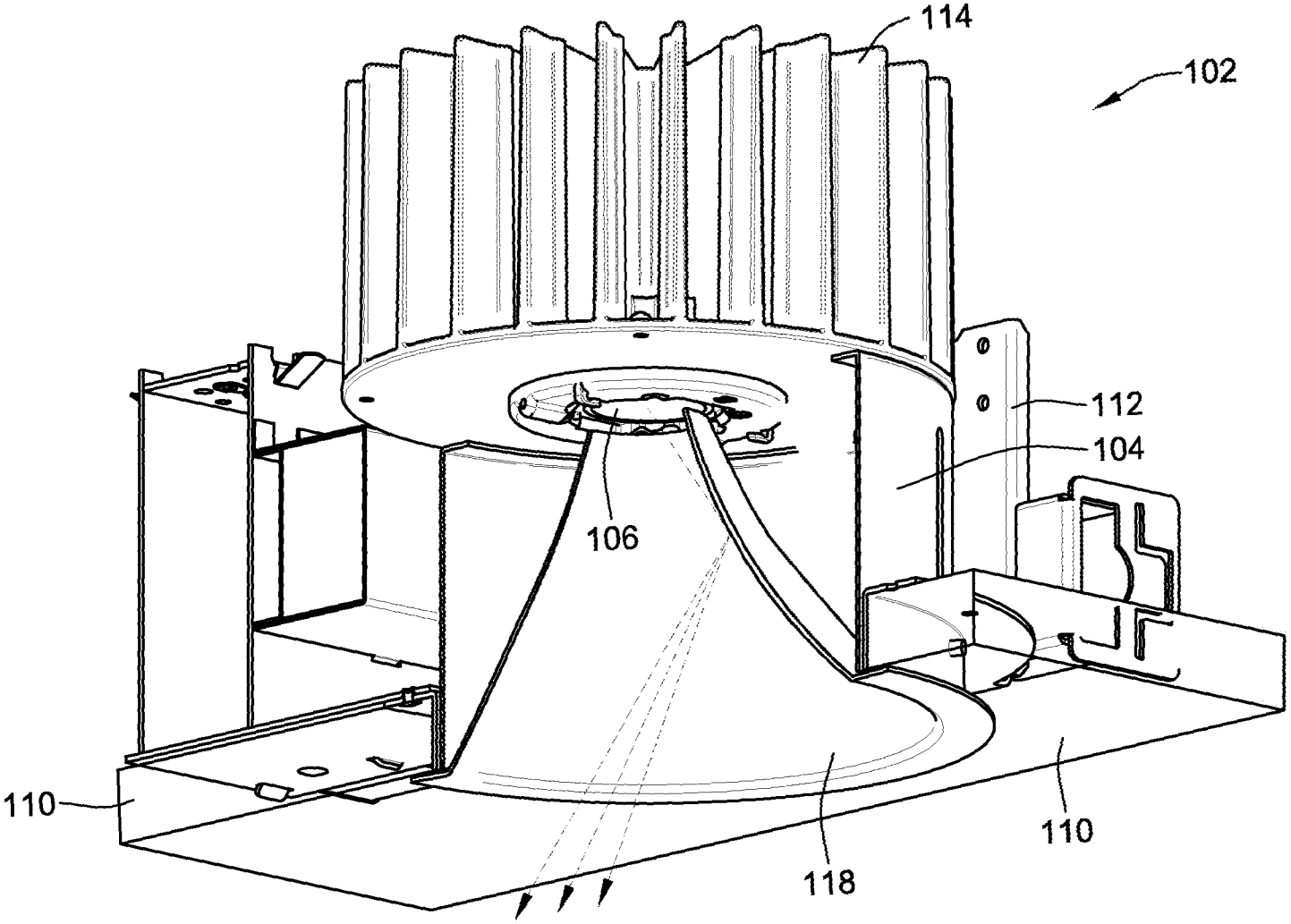
FIG. 1 is a perspective partial cut-away view of a downlight fixture.

Referring to FIG. 1, a downlight fixture 102 includes an optic housing 104, a light-emitting diode (LED) light source 106, and a hyperbolic reflector 118. The optic housing 104 is mountable to a ceiling 110 via an adjustable mounting bracket 112 and is attached to a heat sink 114.

According to one example, the optic housing 104 is a commercial-grade housing that features an extra-low profile for easy installation in a variety of applications. According to another example, the heat sink 114 is directly integrated with the optic housing 104 to maintain LED junction temperatures below specified limits. Efficient thermal management, via the integrated heat sink, of the LED junction temperatures is helpful in achieving at least a 70% level of initial LED light output after about 50,000 hours.

The light source 106 is coupled to the optic housing 104 and, in one example, has a LED light engine that includes at least one LED. The LED light engine 106 is used as a light source for general illumination, accent lighting, or any other commercial lighting application. According to one example, the LED light engine 106 is a chip-on board LED light engine having a 12×12 array of multiple LEDs. The LEDs are under-driven for exceptional efficiency and for outputting light in the range of about 800 to 2,700 fixture lumens. The chip-on board LED light engine is a modular light engine that is easily replaceable and that helps approach 70 lumens per Watt (1 m/W) in efficacy, with various color temperatures, e.g., 2700K, 3000K, 3500K, and 4100K color temperatures, and a minimum color rendering index (CRI) of 80.

The LED light engine 106 emits directional light that is directed towards a floor surface through the hyperbolic reflector 118. The light enters the hyperbolic reflector 118 directly, without further contacting any other component (such as, for example, a lens typically required for parabolic-shaped reflectors). As such, according to one example, the hyperbolic reflector 118 is also referred to as a lens-less reflector. The absence of a lens improves efficacy. However, regardless of whether a lens is used or not, the hyperbolic reflector 118 provides advantages over current reflectors. For example, as discussed in more detail below, the hyperbolic reflector 118 eliminates (or greatly reduces) hot spots in the ceiling.

Figure 2A:
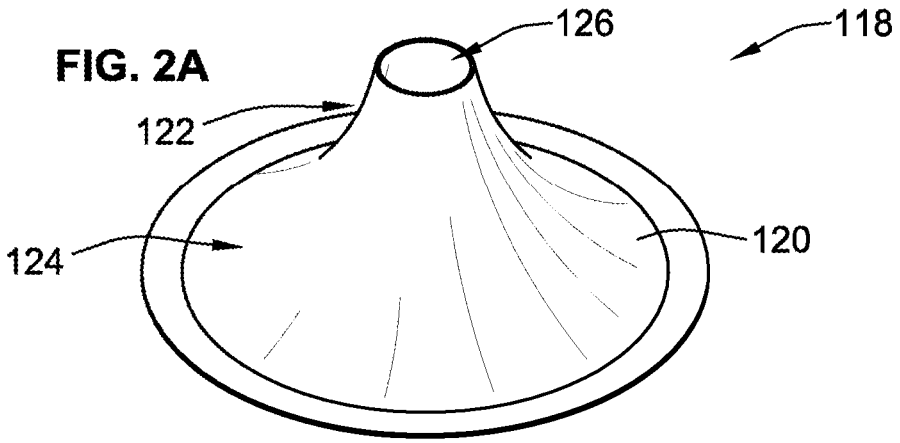
FIG. 2A is a perspective view of a hyperbolic reflector.
Figure 2B:
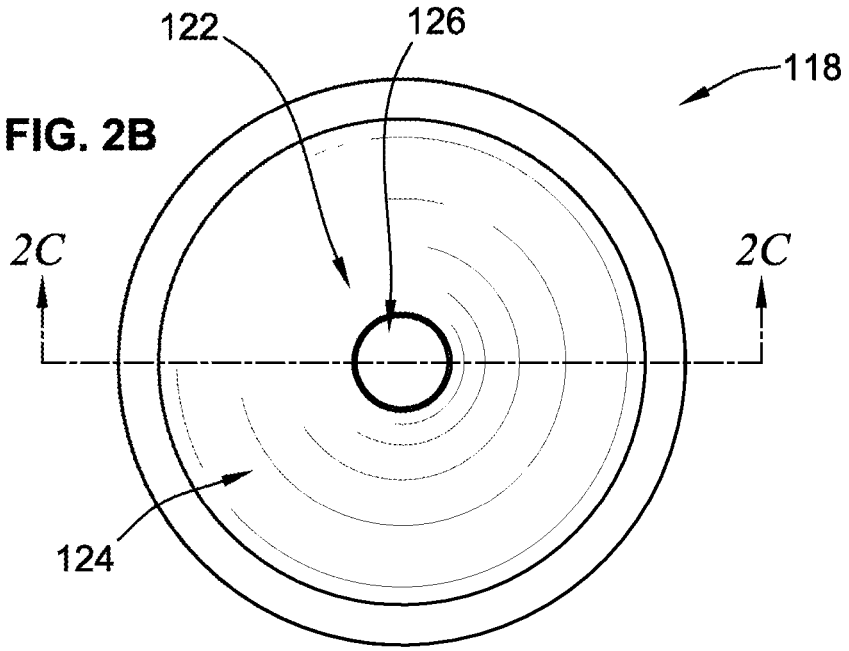
FIG. 2B is a top view of the hyperbolic reflector of FIG. 2A.
Figure 2C:
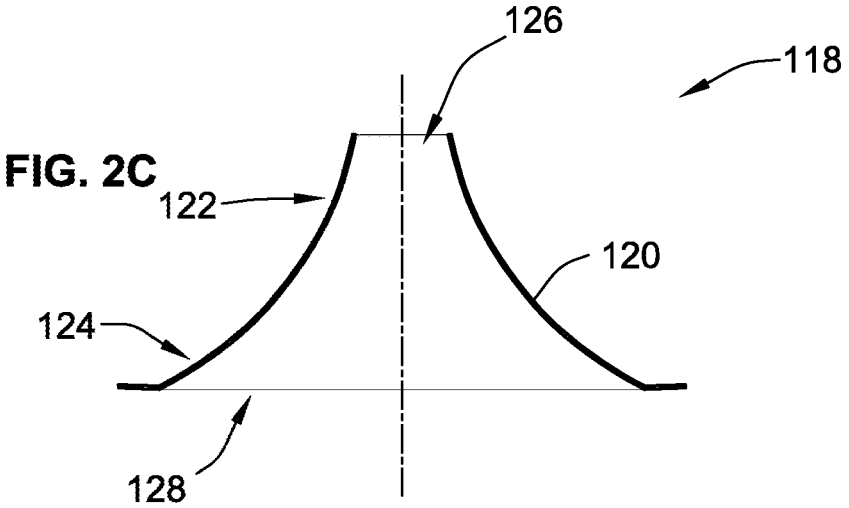
FIG. 2C is a cross-sectional view of the hyperbolic reflector of FIG. 2B.

Referring to FIGS. 2A-2C, the hyperbolic reflector 118 has a hyperbolic wall 120 that continuously extends between a narrow neck 122 and a wide bell 124. The narrow neck 122 has a top opening 126 through which the light enters the hyperbolic reflector 118. The wide bell 124 has a bottom opening 128 through which the light exits the hyperbolic reflector 118.

The hyperbolic wall 120 is shaped to achieve a curvature that curves inwardly towards the longitudinal axis of the hyperbolic reflector 118 (see, e.g., axis Y illustrated in FIG. 3) similar to a trumpet bell from the top opening 126 towards the bottom opening 128. Furthermore, the hyperbolic shape of the wall 120 is determined based on various design factors, including, for example, light distribution requirements, size of the LED light engine 106, height H of the hyperbolic reflector 118 (illustrated in FIG. 4), size of the bottom opening (also referred to as the aperture diameter), etc.

Based on the absence of a separate lens (which would be conventionally required for a parabolic reflector), the hyperbolic reflector 118 can mounted near the LED light engine 106. Accordingly, the top opening 126 is mounted adjacent to the LED light engine 106 and, according to one example, the top opening 126 is mounted flush with, or as close as possible to, a bottom surface of the LED light engine 106 (see FIG. 4).

Figure 3:
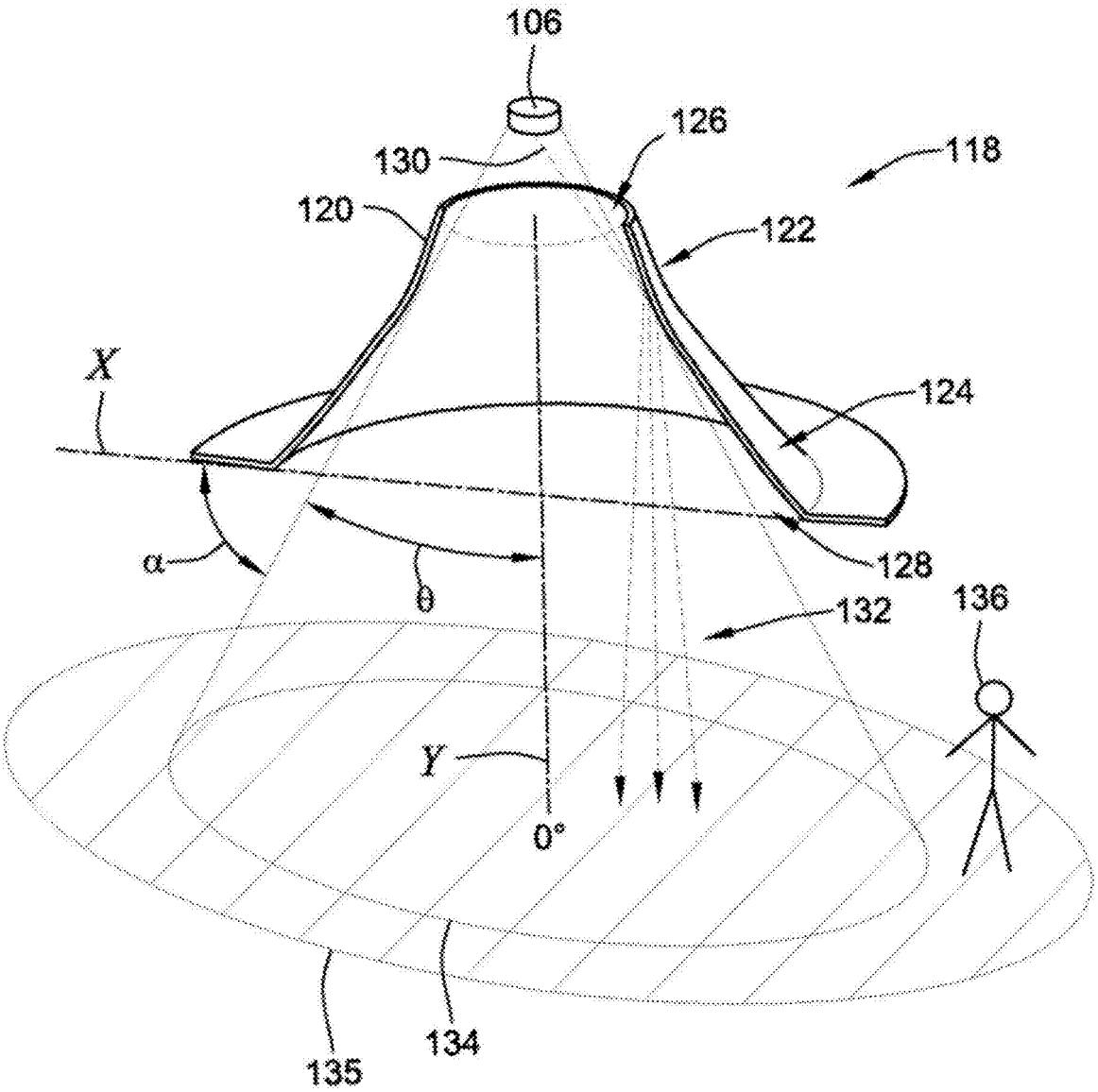
FIG. 3 is a diagrammatic illustration of light from a LED light source being reflected by a hyperbolic reflector.

Referring to FIG. 3, the LED light engine 106 emits directional light rays 130 that travel through the top opening 126 into the hyperbolic reflector 118. Although a single light ray has been represented, for ease of understanding, it is understood that the LED light engine 106 emits many rays. The light rays 130 enter the top opening 126 directly from the LED light engine 106, without changing the course of direction. Thus, the light rays 130 are emitted in a straight path that continues through the top opening 126.

In the hyperbolic reflector 118, the light rays 130 may pass directly through the hyperbolic reflector 118 or may make contact with an internal surface of the hyperbolic wall 120. The light rays 130 that make contact with the internal surface are spread into a light beam 132 that is re-directed towards an illuminated target 134. The light beam 132 exits the hyperbolic reflector 118 through the bottom opening 128 of the wide bell 124. Prior to exiting the bottom opening 128, the light beam 132 may bounce within the hyperbolic reflector 118 making one or more contacts with the internal surface of the hyperbolic wall 120. Based on design considerations, the shape of the hyperbolic wall 120 can be modified to obtain various beam-spread patterns.

The illuminated target 134 refers to an illuminated surface that receives light within a range defined by a cut-off angle θ of the hyperbolic reflector 118. For example, the cut-off angle θ for the hyperbolic reflector 118 is selected such that it prevents glare from the LED light engine 106 until a person 136 is almost underneath the downlight fixture 102.

A non-illuminated area 135 refers to a surface outside the range defined by the cut-off angle θ. Or, conversely, the non-illuminated area 135 refers to a surface inside a range defined by a shielding angle α of the hyperbolic reflector 118. The light beam 132 provides illumination such that an ordinary viewable transition between the illuminated target 134 and the non-illuminated area 135 is minimal to a person 136. In other words, the illuminated target 134 is illuminated with a beam pattern having a smooth distribution of light with smooth edges between the illuminated target 134 and the non-illuminated area 135.

The hyperbolic reflector 118 has a cut-off angle θ (with a complementary shielding angle α) that prevents glare from the LED light engine 106 until the person 136 is almost underneath the downlight fixture 102.

Figure 4:
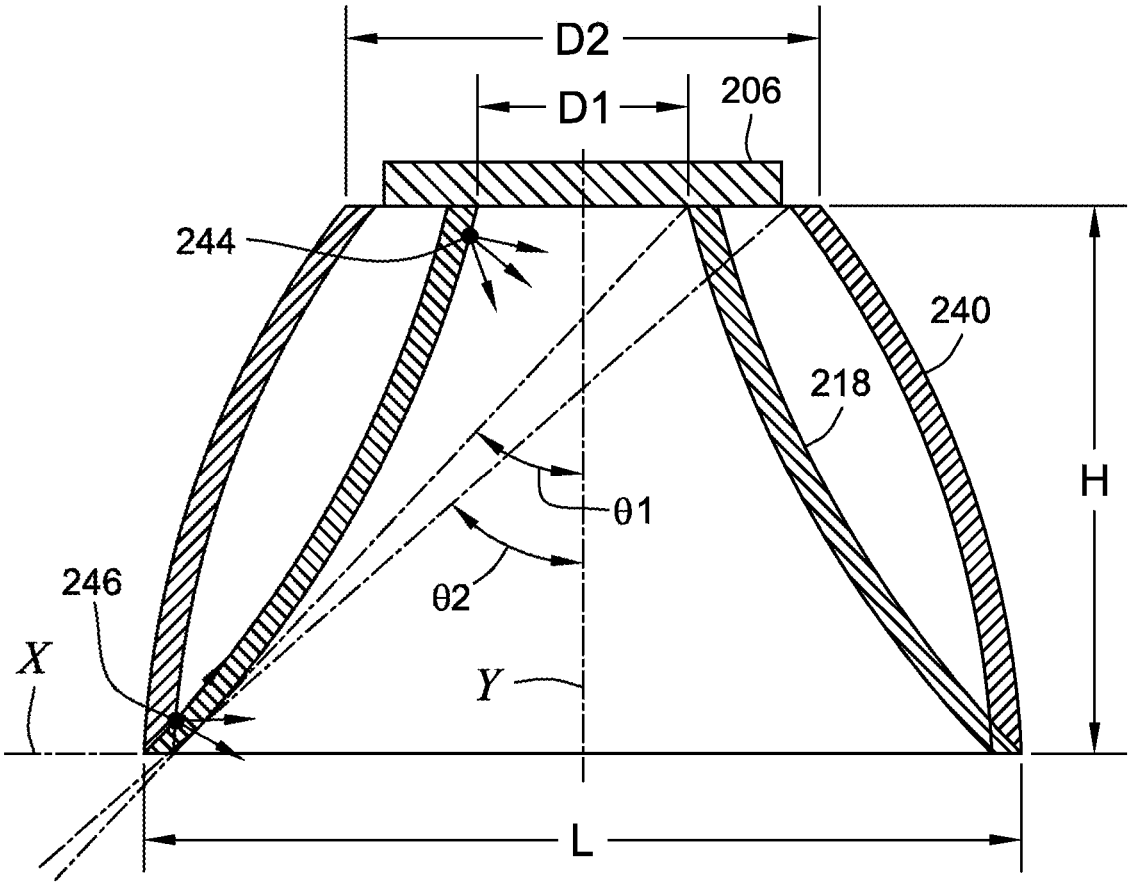
FIG. 4 is a diagrammatic illustration showing a comparison between a hyperbolic and a parabolic reflector.

Referring to FIG. 4, a hyperbolic reflector 218 has an improved, smaller cut-off angle θ1 relative to a cut-off angle θ2 of a parabolic reflector 240. The hyperbolic reflector 218 is comparable to a convex lens, which spreads the light to achieve a smooth light distribution, while the parabolic reflector 240 is comparable to a concave lens, which focuses the light to achieve a relative less smooth light distribution than the hyperbolic reflector 218. According to one example, the cut-off angle θ1 is in the range of about 50 degrees to about 55 degrees.

In the illustrated comparison, the hyperbolic reflector 218 has a top opening of diameter D1 and the parabolic reflector 240 has a top opening of diameter D2. According to one example, the diameter D1 is about 1.486 inches (or, approximately 1.5 inches) and the diameter D2 is about 2.290 inches (or, approximately 2.3 inches). Both reflectors 218, 240 have a bottom opening of equal diameters L and heights H (which is defined as the vertical distance between the respective top and equal bottom openings). According to one example, the diameter L is about 4.312 inches (or, approximately 4.3 inches) and the height H is about 2.250 inches (or, approximately 2.3 inches). As such, the diameter D1 is approximately 30% smaller than the diameter L and, except for their respective shapes, the only dimensional difference between the two reflectors 218, 240 is that the diameter D1 is smaller than diameter D2. In contrast, to be comparable, the parabolic reflector 140 requires the diameter D2 to be more than approximately 50% smaller than the diameter L. In other examples, the diameter L includes a diameter of about 6 inches and a diameter of about 8 inches.

Thus, H/L ratio of the hyperbolic reflector 218 between the height H and the diameter L of the bottom opening is in the range of about 0.29 to about 0.53. In this range, the height H can be as little as half the diameter L. A benefit of achieving a small H/L ratio with the hyperbolic reflector 218 is that it allows the overall height of the fixture 102 to be greatly reduced to accommodate more plenum restrictions and obstacles. In contrast, to achieve the same cut-off angle (i.e., cut-off angle θ2=cut-off angle θ1), the parabolic reflector 240 requires a much greater ratio H/L, in the range of about 1.

As such, the smaller H/L ratio associated with the hyperbolic reflector 218 helps achieve less regression than otherwise possible with the parabolic reflector 240. In other words, a shorter distance can be achieved between a ceiling surface and the position in which the LED light source 206 is mounted within the ceiling relative to the respective reflector 218, 240. Although, for ease of understanding, in FIG. 4 the LED light source 206 is shown to be the same for both the hyperbolic reflector 218 and the parabolic reflector 240, the LED light source 206 will be located much closer to the hyperbolic reflector 218, and the ceiling surface, than to the parabolic reflector 240.

Based on the geometric configurations, the hyperbolic reflector 218 achieves a smaller (and more desirable) cut-off angle θ1 than the cut-off angle θ2 of the parabolic reflector 240. For example, assuming that the diameter D1 is about 1.486 inches, the diameter D2 is about 2.290 inches, the diameter L is about 4.312 inches, and the height is about 2.250 inches, the cut-off angle θ1 for the hyperbolic reflector 218 is 52 degrees compared to the cut-off angle θ2 of 56 degrees for the parabolic reflector 240. As a result, the hyperbolic reflector 218 has a glare spot 244 that is located much higher than a glare spot 246 of the parabolic reflector 240. Thus, glare caused by the hyperbolic reflector 218 requires a viewer to be much closer (e.g., underneath the hyperbolic reflector 218) in comparison to glare caused by the parabolic reflector 240, which would be viewable from much farther away. For example, a cut-off angle θ1 of about 50 degrees would be desirable because it decreases the distance from which the viewer can see the glare. In contrast, a cut-off angle θ2 of about 75 degrees would be undesirable because it increases the distance the distance from which the viewer can see the glare. The lack or diminished effect of glare helps achieve a "quiet" ceiling that lacks shadow rings around the pattern on the floor.

The hyperbolic reflector 218 is also closer to a LED light source 206 and center beam (identified by Y coordinate) than the parabolic reflector 240. By bringing the hyperbolic reflector 218 closer, control of light distribution is improved. For example, brightness control is improved by decreasing the cut-off angle θ1 (relative to cut-off angle θ2). As a result, the image from the LED light source 206 is eliminated and glare and/or aperture brightness is reduced.

Another benefit of the hyperbolic reflector 218 is that it has improved efficiency relative to the parabolic reflector 240. As is well known in the art, parabolic reflectors require lenses to spread (or diffuse) the light. For a desired aperture size in the downlight fixture 202, the parabolic reflector 240 would require a separate lens to achieve the same regression and fixture height as the hyperbolic reflector 218. However, lenses inherently reduce efficiency since they interfere with the light received from the LED light source 206 and passed through to the parabolic reflector 240. This inefficiency, which is inherently present when using the parabolic reflector 240, can be eliminated when using the hyperbolic reflector 218. The hyperbolic reflector 240 does not require a separate lens, based on the ability of the hyperbolic reflector 240 to spread the light upon contact with an internal wall surface. As such, the hyperbolic reflector 240 maximizes delivered lumens and efficacy.

Figure 5A:
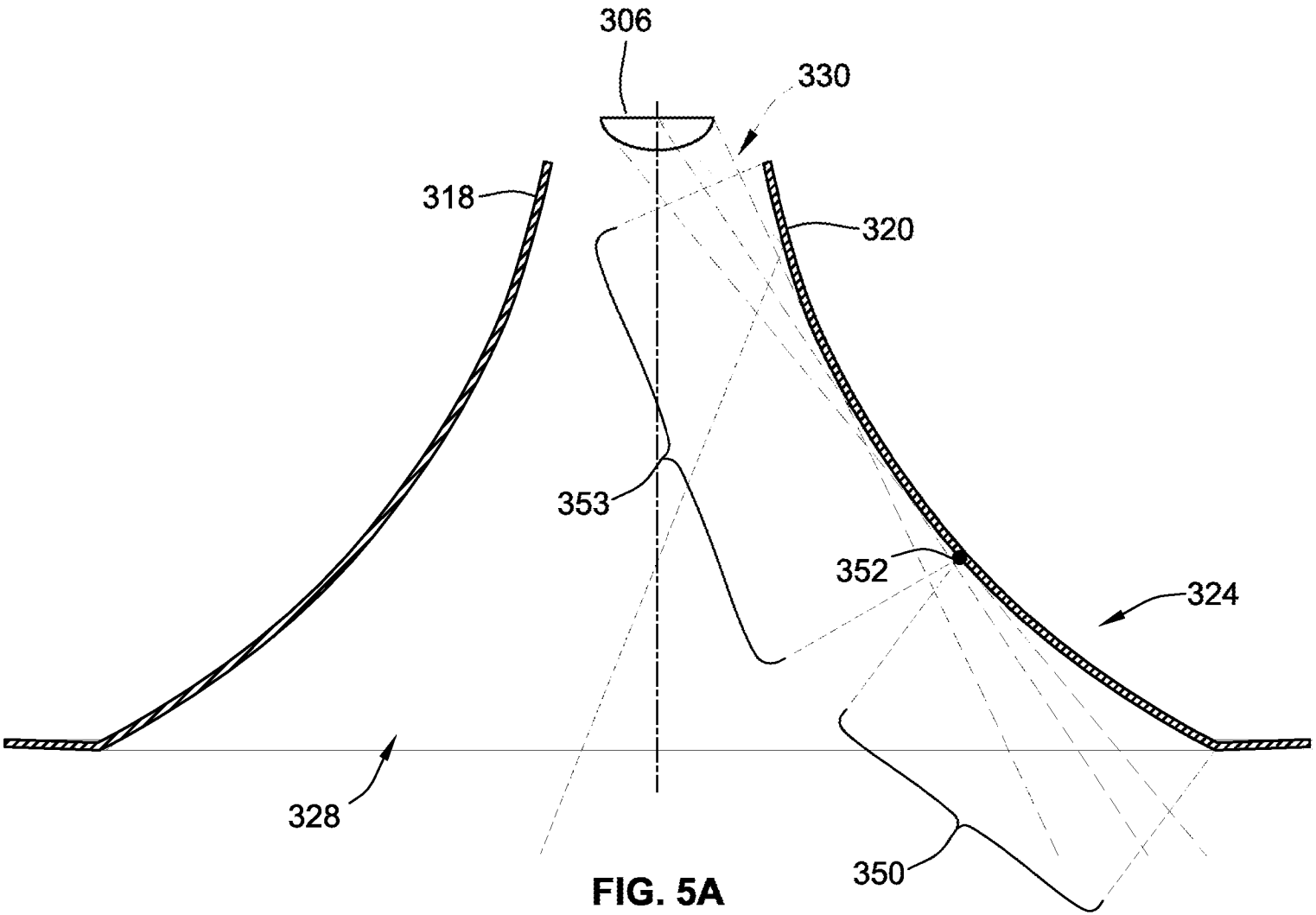
FIG. 5A is a diagrammatic illustration showing a shadow area in a hyperbolic reflector.
Figure 5B:
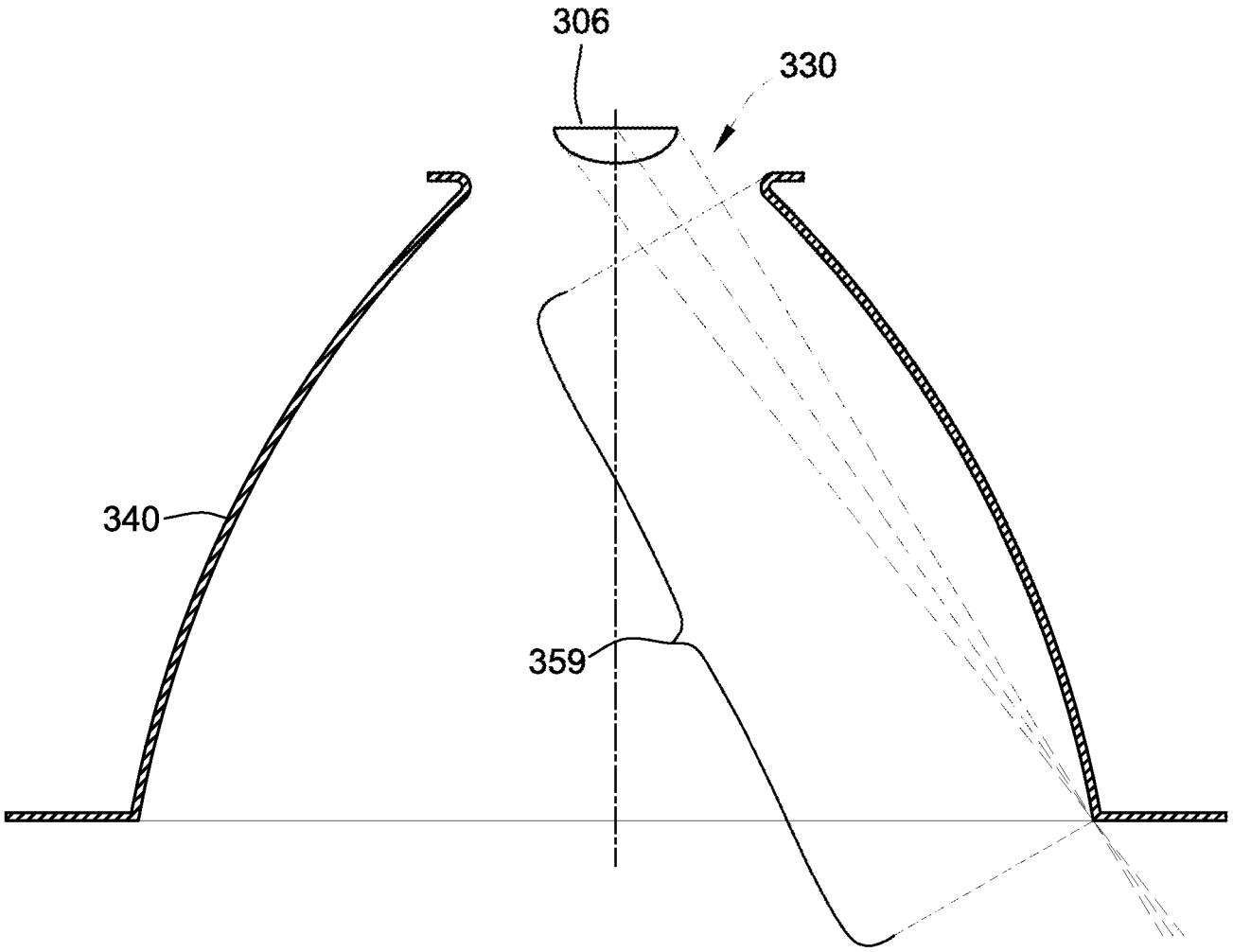
FIG. 5B (PRIOR ART)
FIG. 5B is a diagrammatic illustration showing illumination in a parabolic reflector.

Referring to FIGS. 5A and 5B, a further benefit of a hyperbolic reflector 318 is that an interior area 350 of the wide bell 324 is non-illuminated. Based on the hyperbolic shape of the reflector 318 (shown in FIG. 5A) and the directional nature of LED-emitted light rays, light rays 330 from a LED 306 are prevented from contacting the internal surface of a wall 320 past a threshold point 352. Thus, the light rays 330 can only make contact with the wall 320 within an illuminated area 353, but not within the non-illuminated area 350. In other words, the outward curvature of the wall 320 (relative to the LED 306) bends until the threshold point 352, at which the directional light rays can no longer make contact with the wall 320.

The non-illuminated interior area 350 is also referred to as a shadow area around the outer periphery of the hyperbolic reflector 318 (i.e., around a bottom opening 328). From a viewer perspective, the shadow area 350 reduces typical, undesired brightness around the hyperbolic reflector 318. In contrast to the hyperbolic reflector 318, an internal surface 354 of a prior art parabolic reflector 340 (shown in FIG. 5B) is entirely illuminated, which provides undesired brightness around the parabolic reflector 340.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A downlight reflector, comprising:

a reflective wall that bounds:

a circular upper aperture having a first diameter and centered about an axis, and a circular lower aperture having a second diameter and centered about the axis, the second diameter being greater than the first diameter;

wherein:

the reflective wall increases continuously in diameter from the circular upper aperture to the circular lower aperture, the downlight reflector has no intervening structure between the reflective wall and the axis, and between the circular upper aperture and the circular lower aperture, such that light can pass unimpeded from the circular upper aperture to the circular lower aperture, save for the reflective wall, and at least an inner surface of the reflective wall, facing the axis, defines a curved shape that is convex with respect to the axis;

wherein when a light source is positioned to provide emitted light through the circular upper aperture, the curved shape defines a threshold dividing the inner surface into an upper area, closer to the circular upper aperture, that receives light directly from the light source, and a lower area, adjoining the circular lower aperture, that is shadowed such that the lower area does not receive light directly from the light source.

2. The downlight reflector of claim 1, wherein the curved shape is hyperbolic in cross-section on each side of the axis.

3. The downlight reflector of claim 1, wherein the upper area of the reflective wall reflects a portion of the emitted light toward the circular lower aperture such that the curved shape spreads the portion of the emitted light.

4. The downlight reflector of claim 1, wherein the curved shape creates a cut-off angle in the range of 50 to 55 degrees with respect to the axis.

5. The downlight reflector of claim 1, wherein:

the circular upper aperture and the circular lower aperture are separated by a reflector height, and a ratio of the reflector height to the second diameter is within the range of 0.29 to 0.53.

6. The downlight reflector of claim 1, wherein all portions of the reflective wall from the circular upper aperture to the circular lower aperture are convex with respect to the axis.

7. A downlight fixture, comprising:

a housing;

a heat sink coupled with the housing;

a light-emitting diode (LED) light engine in thermal communication with the heat sink, the LED light engine having at least one LED such that the LED light engine emits light rays in a generally downward direction that is centered about an axis; and a reflective wall that:

is coupled with the housing;

defines an upper aperture having a first diameter, wherein the upper aperture is centered about the axis;

defines a lower aperture having a second diameter, wherein the lower aperture is centered about the axis and the second diameter is greater than the first diameter; and increases continuously in diameter from the upper aperture to the lower aperture;

wherein:

at least an inner surface of the reflective wall, facing the axis, defines a curved shape that is convex with respect to the axis;

no intervening structure exists, between the reflective wall and the axis, and between the upper aperture and the lower aperture, such that light can pass unimpeded from the upper aperture to the lower aperture save for the reflective wall; and when the LED light engine provides emitted light through the upper aperture, the curved shape defines a threshold dividing the inner surface into an upper area, closer to the upper aperture, that receives a portion of the emitted light directly from the LED light engine, but the curved shape blocks the emitted light from contacting a lower area of the inner surface adjoining the lower aperture.

8. The downlight fixture of claim 7, wherein the portion of the emitted light provided by the LED light engine that illuminates the upper area does not pass through a lens between the LED light engine and the upper area.

9. The downlight fixture of claim 8, wherein the upper area of the reflective wall reflects the portion of the emitted light toward the lower aperture such that the curved shape spreads the portion of the emitted light such that the downlight fixture achieves comparable optical performance and improved efficacy, as compared to a light fixture of substantially the same external dimensions, that utilizes a parabolic reflector and a lens.

10. The downlight fixture of claim 7, wherein all portions of the reflective wall from the upper aperture to the lower aperture are convex with respect to the axis.

11. The downlight fixture of claim 10, wherein the curved shape is hyperbolic in cross-section on each side of the axis.

12. The downlight fixture of claim 7, wherein the LED light engine is mounted directly to the heat sink.

13. The downlight fixture of claim 7, wherein the LED light engine is mounted flush with the upper aperture.

14. The downlight fixture of claim 7, wherein the curved shape creates a cut-off angle in the range of 50 to 55 degrees with respect to the axis.

15. The downlight fixture of claim 7, wherein the upper aperture and the lower aperture are separated by a height, extending along the axis, and a ratio of the height to the second diameter is within the range of 0.29 to 0.53.

16. The downlight fixture of claim 15, wherein:

the first diameter is about 1.5 inches;

the second diameter is about 4.3 inches; and the height is about 2.3 inches.

17. The downlight reflector of claim 5, wherein:

the threshold and the circular lower aperture are vertically separated by a threshold height; and a ratio of the threshold height to the reflector height is greater than 0.2.

18. The downlight reflector of claim 17, wherein:

an inner diameter of the reflective wall at the threshold is a threshold diameter; and a ratio of the threshold diameter to the second diameter is less than 0.8, so that the lower area reduces undesired brightness adjacent to the circular lower aperture.

19. A downlight reflector, comprising a reflective wall that:

defines an upper aperture that is centered about an axis and that defines an entry area;

defines a lower aperture that is centered about the axis and that defines an exit area, the exit area being greater than the entry area; and defines a curved shape that is convex with respect to the axis, along at least part of the axis, wherein:

a distance from the axis to the reflective wall does not decrease, at any point along the axis, as the reflective wall proceeds from the upper aperture to the lower aperture, such that the entry area is continuously connected to the exit area via the reflective wall at every point along the axis between the upper aperture and the lower aperture, and such that light can pass unimpeded from the upper aperture to the lower aperture save for the reflective wall; and the curved shape is configured to create a threshold dividing an inner surface of the reflective wall into:

a non-illuminated area that adjoins the lower aperture, and an illuminated area that is closer to the upper aperture than is the non-illuminated area;

wherein, when a light source that is centered on the axis emits light through the upper aperture, a portion of the emitted light can pass in a straight line from the light source to the illuminated area, but the curved shape blocks the emitted light from passing in a straight line from the light source to the non-illuminated area.

* * * * *